US006244819B1

(12) United States Patent
Voorhees

(10) Patent No.: US 6,244,819 B1
(45) Date of Patent: Jun. 12, 2001

(54) ADJUSTABLE SUPPORTING ASSEMBLY FOR TURBINE FLOWPATH COMPONENTS AND METHOD THEREOF

(75) Inventor: Peter Voorhees, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/437,676

(22) Filed: Nov. 10, 1999

Related U.S. Application Data

(60) Provisional application No. 60/107,749, filed on Nov. 10, 1998.

(51) Int. Cl.[7] ..... F01D 25/28

(52) U.S. Cl. ..... 415/213.1; 415/214.1; 415/220

(58) Field of Search ..... 415/201, 213.1, 415/214.1, 220, 108; 403/335, 336

(56) References Cited

U.S. PATENT DOCUMENTS

| | | | | |
|---|---|---|---|---|
| 2,247,423 | | 7/1941 | Webster, Jr. . | |
| 3,592,557 | * | 7/1971 | Haas | 415/136 |
| 3,628,884 | | 12/1971 | Mierley, Sr. . | |
| 3,754,833 | * | 8/1973 | Remberg | 415/108 |
| 3,892,500 | | 7/1975 | Miller et al. . | |
| 3,937,433 | | 2/1976 | Portaleoni . | |
| 4,177,003 | * | 12/1979 | Remberg et al. | 415/108 |
| 5,123,812 | * | 6/1992 | Groenendaal, Jr. et al. | 415/209 |
| 5,666,724 | | 9/1997 | Kolsum . | |
| 5,810,558 | | 9/1998 | Streeter . | |

* cited by examiner

*Primary Examiner*—Edward K. Look
*Assistant Examiner*—Ninh Nguyen
(74) *Attorney, Agent, or Firm*—Haynes and Boone, LLP

(57) ABSTRACT

An adjustable supporting assembly in a fluid driven machine with a rotating shaft includes a housing having a chamber with an inner surface, a stationary flowpath component comprising at least first and second portions, and at least one supporting structure. The stationary flowpath component extends around and radially outward from the shaft to an outer surface. The stationary flowpath component is also disposed within the chamber with the outer surface of the stationary flowpath component adjacent to the inner surface of the housing. The supporting structure supports the first portion of the stationary flowpath component in a first position and is adjustable to other positions. The supporting structure also secures the first and second portions of the stationary flowpath component together.

25 Claims, 4 Drawing Sheets

ADJUSTABLE SUPPORTING ASSEMBLY FOR TURBINE FLOWPATH COMPONENTS AND METHOD THEREOF

This application claims the benefit of U.S. Provisional Patent Application Ser. No. 60/107,749 filed on Nov. 10, 1998 which is herein incorporated by reference.

FIELD OF THE INVENTION

This invention relates generally to a fluid driven machine and, more particularly, to an adjustable supporting assembly for flowpath components in a machine, such as a turbine, and a method thereof.

BACKGROUND OF THE INVENTION

In a turbine, alignment of stationary flowpath components with respect to rotating flowpath components, such as a shaft or rotor wheel, is crucial. Typically, some spacing must be provided between the stationary and rotating flowpath components. If the alignment is off, then the spacing between the stationary and rotating flowpath components may be to large or to small. If the spacing is to large, then there may be to much leakage of a motive fluid, such as steam, between the stationary and rotating flowpath components and thus a decrease in overall efficiency of the turbine. If the spacing is to small, then the stationary flowpath components may rub against the rotating flowpath components damaging the turbine.

Transient temperature differentials typically experienced by the turbine during normal operations make it difficult to properly align and space the stationary flowpath components with respect to the rotating flowpath components. When stationary flowpath components lose alignment with the rotating flowpath components the efficiency of the turbine is decreased and/or the turbine may be damaged.

One technique for supporting and centering stationary flowpath components with respect to the rotating shaft involves the use a pair of lug arrangements for the upper half of a diaphragm and another pair of lug arrangements for the lower half of the diaphragm. One example of such a system is disclosed in U.S. Pat. No. 2,247,423 to Webster which is herein incorporated by reference. With this technique, proper centering of the diaphragm requires that the diaphragm's center coincide with the center or axis of the casing which means that the face of the lower half of the diaphragm be located in a plane through the joint or dividing plane between the casing halves. Lug arrangements on opposite sides of the lower half of the diaphragm are used to achieve this and hold the diaphragm in place in the lower half of the casing. Similarly, lug arrangements on opposite sides of the upper half of the diaphragm are used to locate the face of the upper half of the diaphragm in a plane through the joint or dividing plane between the casing halves. Additionally, the lower half of the diaphragm is centered horizontally in the lower casing half by a vertical pin secured in a groove in the bottom portion of the lower casing half and slidably projecting into a vertical bore in the lower half of the diaphragm.

Unfortunately, this technique has some problems. For example, when this technique is used, proper sealing at the split line between halves of the diaphragm is difficult because the lug arrangements are concerned with centering the lower and upper halves of the diaphragm with the face at the split line for the lower and upper casing halves, respectively, and not with forming a tight seal between the diaphragm halves. Additionally, with this technique the diaphragm halves are not properly aligned because they are aligned with respect to the casing, not the shaft.

SUMMARY OF THE INVENTION

An adjustable supporting assembly in accordance with one embodiment of the present invention in a fluid driven machine with a rotating shaft includes a housing having a chamber with an inner surface, a stationary flowpath component comprising at least first and second portions, and at least one supporting structure. The stationary flowpath component extends around and radially outward from the shaft to an outer surface. The stationary flowpath component is also disposed within the chamber with the outer surface of the stationary flowpath component adjacent to the inner surface of the housing. The supporting structure supports the first portion of the stationary flowpath component in a first position and is adjustable to other positions. The supporting structure also secures the first and second portions of the stationary flowpath component together.

An adjustable support in accordance with another embodiment of the present invention in a fluid driven machine with a rotating shaft includes a housing having a chamber with an inner surface, a stationary flowpath component comprising at least first and second portions, and at least one supporting structure. The stationary flowpath component extends around and radially outward from the shaft to an outer surface and is disposed within the chamber with the outer surface of the stationary flowpath component adjacent to the inner surface of the housing. The supporting structure extends through a first passage in the first portion of the stationary flowpath component, past a split line separating the first and second portions of the stationary flowpath component, and into a second passage in the second portion of the stationary flowpath component. The supporting structure adjusts the position of at least the first portion of the stationary flowpath component with respect to the shaft and the inner surface of the housing.

An adjustable support in accordance with another embodiment of the present invention in a fluid driven machine with a rotating shaft includes a housing having a chamber with an inner surface, a stationary flowpath component comprising at least first and second portions, at least one supporting structure, and a pin and a notch shaped to mate with the pin. The stationary flowpath component extends around and radially outward from the shaft to an outer surface and is disposed within the chamber with the outer surface of the stationary flowpath component adjacent to the inner surface of the housing The supporting structure is adjustable to alter a position of at least the first portion of the stationary flowpath component with respect to the shaft and the inner surface of the housing. The pin and the notch are located along the inner surface of the housing and the outer surface of the first portion of the stationary flowpath component. A first clearance is defined along at least one side of the pin.

A method for adjusting components in a chamber of a housing of a fluid driven machine, the housing having a shaft which rotates about a first axis and is located at least partially within the chamber in accordance with another embodiment of the invention includes a few steps. First, a position of a first portion of a stationary flowpath component with respect to the shaft in the chamber is adjusted with at least one supporting structure. Next, a second portion of the stationary flowpath component is secured to the first portion of the stationary flowpath component with the supporting structure.

With the present invention, the apparatus and method for aligning the halves of the stationary flowpath components with respect to the rotating shaft is simplified. Instead of using arrangements which separately adjusted the upper and lower halves of the stationary flowpath components, the present invention uses one arrangement to align both the upper and lower halves of the stationary flowpath component. As a result, the present invention is simpler and quicker to use because only one arrangement needs to be adjusted to align both halves. The simpler design also helps to reduce the overall cost of the alignment mechanism when compared to prior systems.

The present invention also provides a tighter seal between the upper and lower halves of the stationary flowpath components which helps to reduce or eliminate leakage between the halves of the stationary flowpath component and thus increase the overall efficiency of the machine. This tighter seal is accomplished by securing the upper and lower halves of the stationary flowpath component together with the same structure which is used to align the lower half (and thus also the upper half) of the stationary flowpath component.

Additionally, with the present invention the assembly and disassembly of the machine is also much easier and is less likely to result in damage to the stationary flowpath components. Unlike the prior systems described earlier, with the present invention the upper half of the stationary flowpath component is secured to the lower half of the stationary flowpath component and not to the upper half of the casing.

Further, with the present invention both lateral movement along with vertical movement of the stationary flowpath component with respect to the shaft is possible. As a result, more positions for the proper alignment of the stationary flowpath component are possible ultimately resulting in a more efficient machine. In some applications, alignment of the split line for the diaphragm halves is off center with respect to the halves of the casing.

Another advantage of the present invention is the ability for the turbine case and flowpath components to grow/shrink thermally and maintain alignment. No rigid connection is used between the two components which would stress or move the components relative to each other if their shape changes. A large enough space/clearance is provide between the inside of the turbine case and outside diameter/surface of the flowpath component. The posts which support the flowpath components are able to slide within pockets in the turbine case. The bottom pin maintains the centering of the turbine and accommodates any vertical difference between the turbine case and flowpath components by sliding within a groove in the flowpath component, yet has a tight side clearance to maintain the steampath component lateral position.

Another feature of the present invention is the flowpath component is locked into the turbine case lower half. The weight of the steampath component is not relied on to prevent it from lifting. This lifting of the steampath component can occur during the lifting of the turbine case upper half for maintenance or during turbine operation, with the combination of pressure and temperature effects. A lifting in either case can change the seals at the center of the flowpath component.

Yet another advantage of the present invention is the simple machining requirements for making the assembly. The flowpath component has only a partially threaded through hole on each side of the lower half and the post is sized to fit within the tap drill through hole. The post may be a round piece with a notch cut to create a foot like feature which engages in an opening in the turbine case.

DETAILED DESCRIPTION

Figure 1:
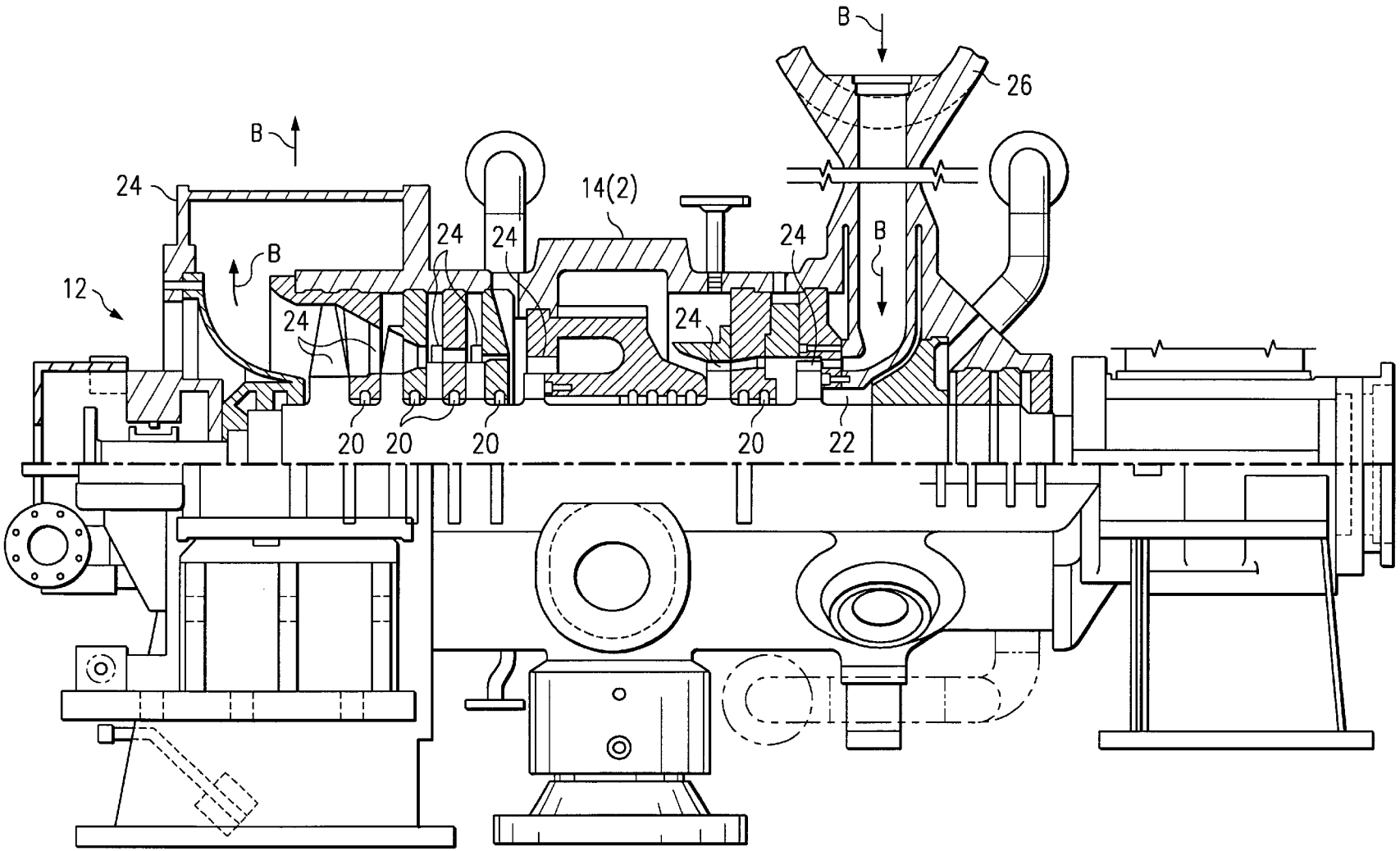
FIG. 1 is a cross-sectional view of turbine with adjustable supports for turbine flowpath components in accordance with the present invention.
Figure 2:
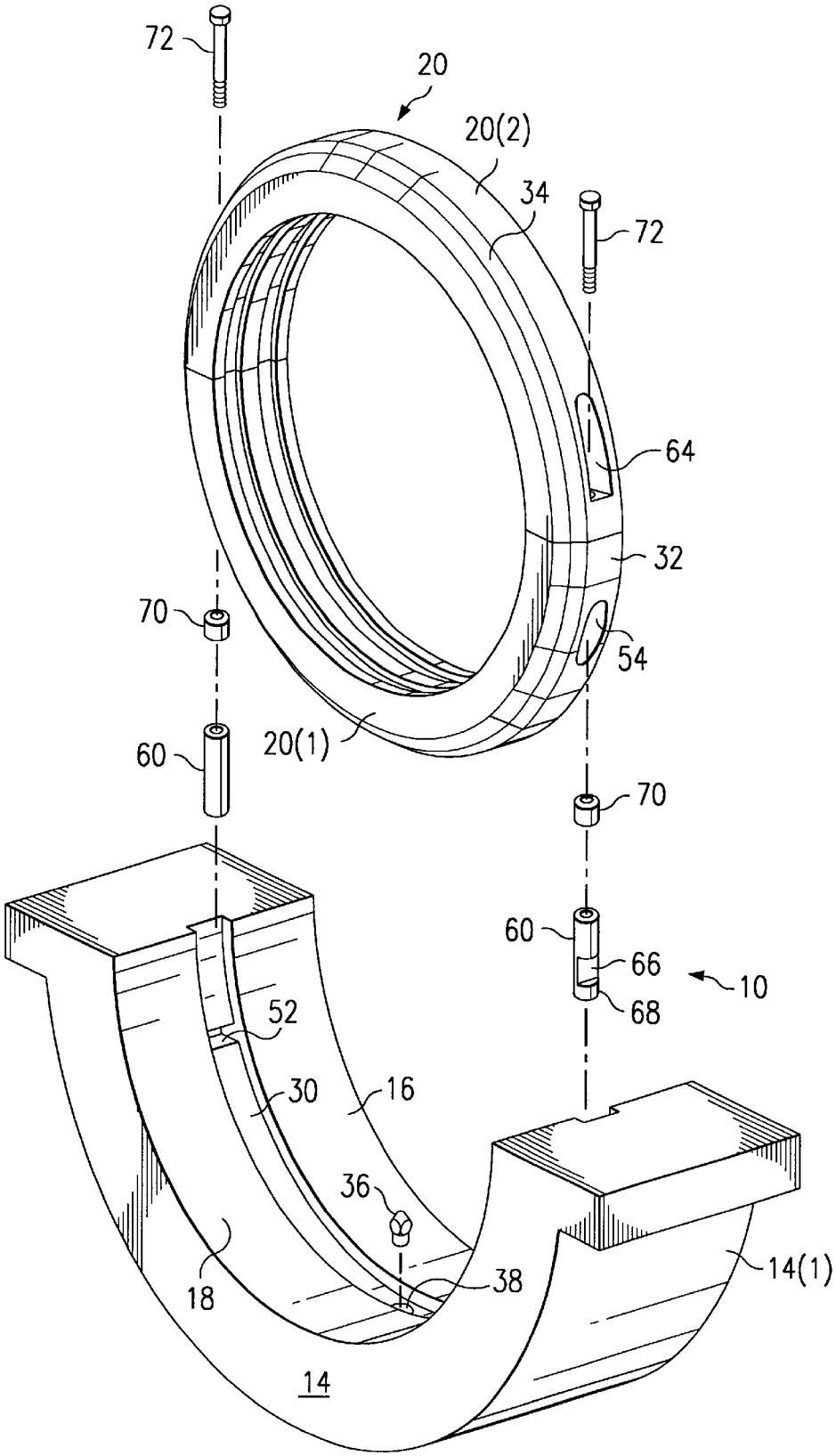
FIG. 2 is an exploded, perspective view of an adjustable support in accordance with the present invention.
Figure 3:
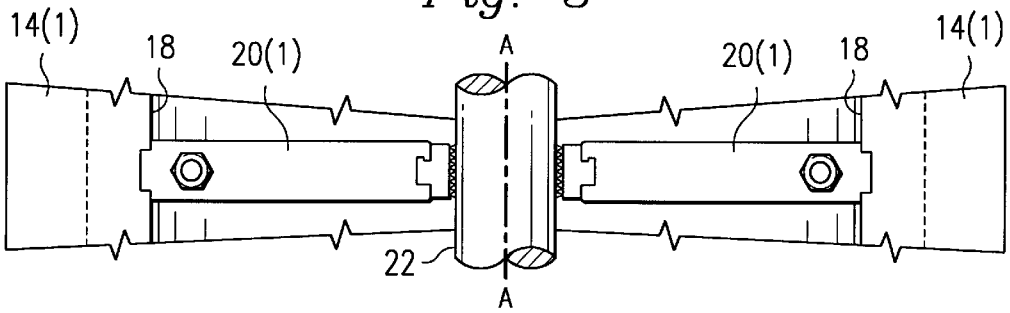
FIG. 3 is partial, top, cross-sectional view of an adjustable support in accordance with the present invention.

An adjustable supporting assembly 10 in accordance with one embodiment of the present invention in a machine 12 is illustrated in FIGS. 1 and 2. The machine 12 includes a housing 14 having a chamber 16 with an inner surface 18 and a stationary flowpath component 20. The present invention provides a number of advantages including simplifying the process for aligning the stationary flowpath component 20 with respect to a shaft 22, providing both lateral and vertical movement by just turning a threaded bushing. The present invention also provides a tighter seal between the upper and lower halves 20(1) and 20(2) of the stationary flowpath component 20. Further, the present invention makes the assembly and disassembly of the housing 14 of the machine 12 easier by securing the upper half 20(2) of the stationary flowpath component 20 to the lower half 20(1) instead of to an upper half 14(2) of the housing 14.

Referring more specifically to FIG. 1, the machine 12 is a turbine in this particular embodiment, although other types of fluid driven machines 12 can be used. The shaft 22 extends along and rotates about axis A—A in the machine 12. Rotor wheels 24 are mounted on or are integrally formed with the shaft 22 and extend radially outward from the shaft 22 to a radially outermost periphery.

The machine 12 also includes the housing 14 or casing which is connected between an inlet casino 26 and an exhaust casing 24. The housing 14 defines an inner chamber 16 which surrounds the shaft 22, the rotor wheels 24, and the stationary flowpath components 20, which in this particular embodiment are diaphragms although other types of stationary flowpath components 20 can be used. Since in this example the other stationary flowpath components 20 in FIG. 1 are identical to the one described below with reference to FIGS. 2–6, the other stationary flowpath components 20 will not be discussed here. The chamber 16 retains the working or motive fluid in the machine 12. The direction of flow of a motive fluid, such as steam, in the machine 12 is illustrated by the arrows B in FIG. 1.

Figure 4:
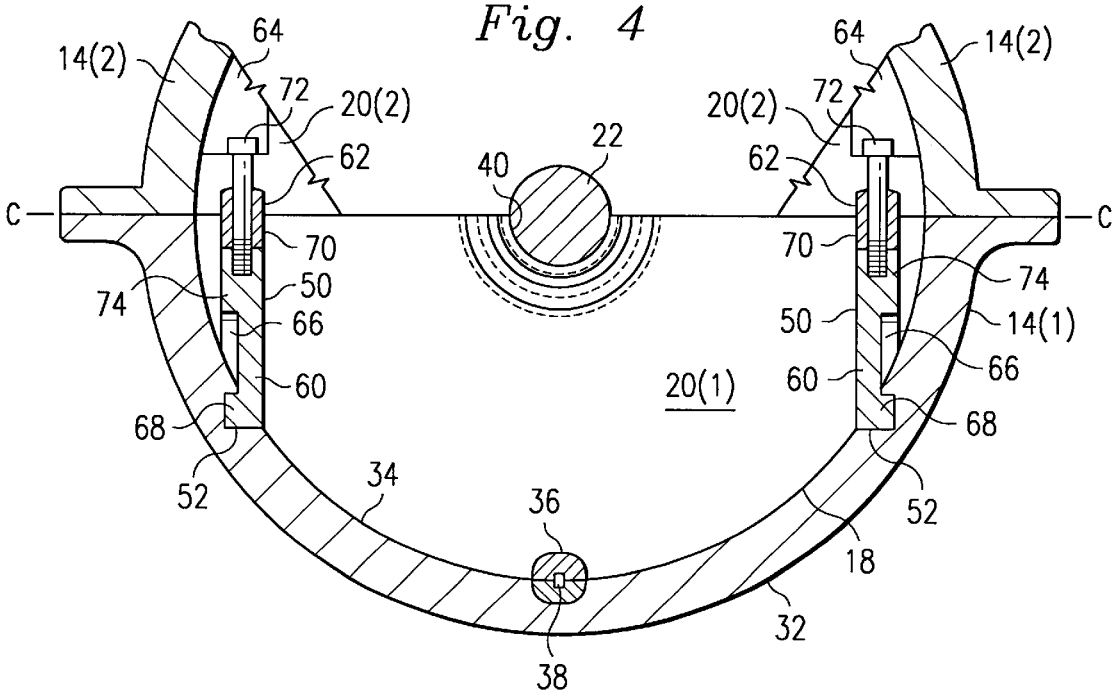
FIG. 4 is a partial, side, cross-sectional view of an adjustable support in accordance with the present invention.
Figure 5:
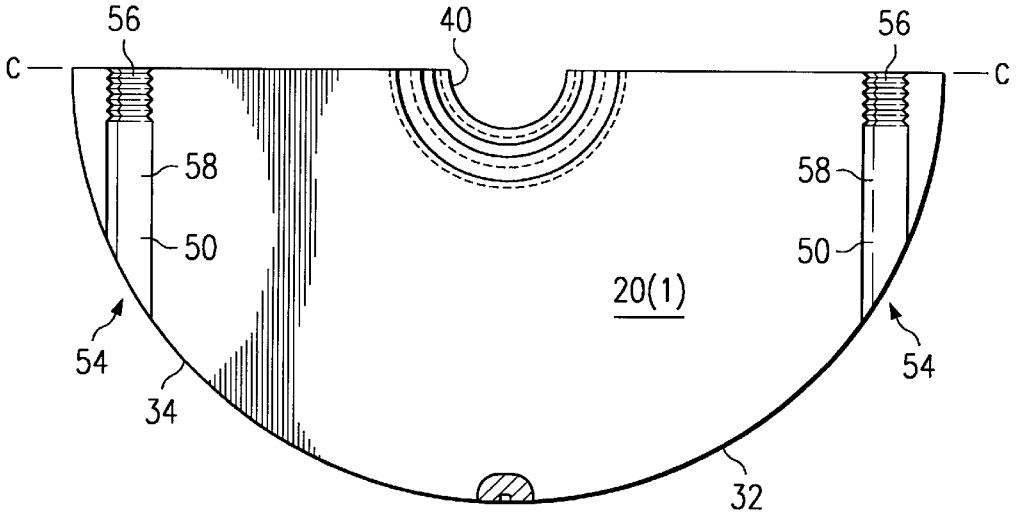
FIG. 5 is an enlarged, side, cross-sectional view of a passage in a stationary flowpath component for the adjustable support.

Referring to FIGS. 2 and 4, the housing 14 is split into halves 14(1) and 14(2) along a split line C—C in this particular embodiment, although the housing 14 can be split into more than two parts as needed or desired. The halves 14(1) and 14(2) of the housing are held together by bolts or other securing devices (not shown). A groove 30 is formed along an inner surface 18 of the chamber 16 in the housing 14 and extends substantially around the inner circumference of the chamber 16 of the housing 14, although other shapes and configurations for the groove 30 are possible, such as having a discontinuous groove. The groove 30 is designed to receive an outer edge or lip 32 along an outer surface 34 of the stationary flowpath component 20. Alternatively, a protrusion (not shown) could be formed along the inner surface 18 of the chamber 16 in the housing 14 which fits within a groove (not shown) along an outer surface 34 of the stationary flowpath component 20.

Figure 6:
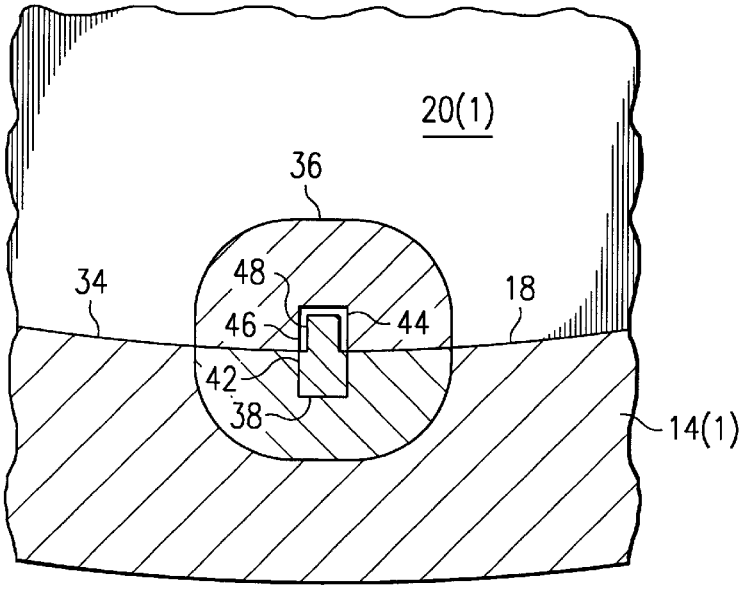
FIG. 6 is an enlarged, not to scale, side, cross-sectional view of a pin and notch in a stationary flowpath component and a housing.

Referring to FIGS. 2, 4, and 6, in this particular embodiment one end 42 of a centering pin 36 is designed to fit snugly within a hole 38 formed along the inner surface 18 of the chamber 16 in the housing 14. The centering pin 36 extends from this hole 38 towards the shaft 22 or shaft opening 40 in the stationary flowpath component 20. The other end 44 of the centering pin 36 is designed to fit within a matching slot 46 in the outer surface 34 of the stationary flowpath component 20. In this particular embodiment, a clearance (not to scale) 48 is provided for on each side of the other end 44 of the pin 36 in the outer surface 34 of the stationary flowpath component 20 to permit some rotational movement of the stationary flowpath component 20, although the other end 44 of the centering pin 36 could be designed to fit snugly within a hole 46 in the outer surface 34 of the stationary flowpath component 20 with a clearance provided for on each side of the one end 42 of the pin 36 in the hole 38 in the housing 14. Additionally, a space 48 may be provided along only one side of the one or the other end 42 or 44 of the pin 36. The space or spaces 48 permit some lateral or rotational movement of the stationary flowpath component 20 so that proper alignment can be achieved. In this particular embodiment the space 50 on each side ranges between about 0.000 and 0.002. The centering pin 36 is used to orient one half 20(1) of the stationary flowpath component 20 in to the one half 14(1) of the housing 14.

Referring to FIGS. 2–6, one of the stationary flowpath components 20 is illustrated. The stationary flowpath component 20 is spaced from and extends radially outward from the shaft 22 to the outer surface 34. The stationary flowpath component 20 is split into halves 20(1) and 20(2) along the split line C—C, although the stationary flowpath component 20 can be split into more than two parts as needed or desired. As discussed earlier, in this particular embodiment, the stationary flowpath component 20 has the outer edge or lip 32 along the outer surface 34 which mates with the groove 30 in the housing 14, although other types of mating arrangements between the outer surface 34 of the stationary flowpath component 20 and the inner surface 18 of the chamber 16 can be used.

A pair of passages 50 are formed in one half 20(1) of the stationary flowpath component 20, although the number of passages 50 can vary. Each of the passages 50 extends from the split line C—C for the stationary flowpath component 20, through a portion of the stationary flowpath component 20(1), and out through the outer surface 34 of the stationary flowpath component 20. A slot or notch 52 is formed in the inner surface 18 of the chamber 16 of the half 14(1) of housing 14 adjacent to the opening 54 for each of the passages 50 at the outer surface 34 of the half 20(1) of the stationary flowpath component 20. Each of the passages 50 in this particular example has a threaded portion 56 adjacent the split line C—C and an unthreaded portion 58 below that, although the entire passage 50 could be threaded. The circumference or outer envelope of each of the passages 50 is larger than the circumference or outer envelope of each of the guide posts 60 which are inserted into the passages 50.

Another pair of passages 62 are formed in the other half 20(2) of the stationary flowpath component 20, although the number of passages 62 can vary. Each of these passages 62 also extends from the split line C—C for the stationary flowpath component 20, through a portion of the half 20(2) of the stationary flowpath component 20, and out through the outer surface 34 of the stationary flowpath component 20. When the halves 20(1) and 20(2) of the stationary flowpath component 20 are brought together along the split line C—C, the passages 50 are aligned with the passages 62.

A pair of pockets 64 are also formed in the other half 20(2) of the stationary flowpath component 20, although the number of pockets 64 can vary as needed or desired. Each of the pockets 64 extends in from the outer surface 34 of the stationary flowpath component 20 in the general direction of the shaft 22 and provides access to the passages 62.

As discussed earlier, a guide post 60 is located in each of the passages 50. The circumference or outer envelope of each of the guide posts 60 is less than the circumference or outer envelope of each of the passages 50. In this particular embodiment, one end of each of the guide posts 60 has notch or recess 66 cut in adjacent one end to form a lip or foot 68 adjacent the bottom of the post 60. The lip 68 is shaped to mate with the slot or notch 52 formed in the inner surface 18 of the chamber 16 of the housing 14 adjacent to the opening 54 for each of the passages 50.

A bushing 70 is located in the threaded portion 56 of each of the passages 50. The bushing 70 has an outer surface with threads which mate with the threads 56 along the inner surface of the passage 50. When the bushings 70 are threaded into their respective passages 50, one end of each of the bushings 70 is seated against one end of each of the guide posts 60. The bushings 70 and guide posts 60 secure the one half 20(1) of the stationary flowpath component 20 to the one half 14(1) the housing 14 and are used to align the one half of the stationary flowpath component 20 with respect to the shaft 22.

In this particular embodiment, one end of the bushing 70 extends up past the split line C—C for the one half 20(1) of the stationary flowpath component 20, although the bushing 70 could be located below the split line C—C. If a portion of one or both of the bushings 70 extends up past the split line C—C for the one half 20(1) of the stationary flowpath component 20, then the passage or passages 62 in the other half 20(2) of the stationary flowpath component 20 are designed to clear with or fit over these portions of the bushings 70.

A bolt 72 or other type of securing device extends from the passage 62 in the other half 20(2) of the stationary flowpath component 20 into the passage 50 in the one half 20(1) of the stationary flowpath component 20. In this particular embodiment, the bolt 72 is screwed into a threaded passage 74 into the top of the post 60. The bolt 72 passes through a clearance hole in the bushing 70 and threads into the post 60. When the bolt 72 is tightened, the post 60, bushing 72 upper and lower halves 20(1) and 20(2)of the flowpath component 20 became a rigid assembly. The bolt 72 is used to secure the other half 20(2) of the stationary flowpath component 20 to the one half 20(1) of the stationary flowpath component 20 and not to the other half 14(2) of the housing 14. By not relying upon the other half 14(2) of the housing 14 to hold the other half 20(2) of the stationary flowpath component 20 in place, the other half 14(2) of the housing 14 is easier to remove and the other half 20(2) of the stationary flowpath component 20 is less likely to damaged. Movement of the other half 20(2) of the stationary flowpath component 20 can result in seal damage.

The operation of one particular embodiment of the adjustable supporting assembly 10 in a machine 12 will be illustrated with reference to FIGS. 1, 2, 4, and 6. First, the halves 14(1) and 14(2) of the housing 14 are separated to expose the chamber 16. Next, one end of a guide post 60 with a lip 68 formed by a notch 66 in the post 60 is secured in a notch 52 in the inner surface 18 of the chamber 16.

Once the guide posts 60 are in place, one half 20(1) of the stationary flowpath component 20 is placed in the one half 14(1) of the housing 14 with the guide posts 60 being inserted into the passages 50 on opposing sides of the one half 20(1) of the stationary flowpath component 20. Additionally, in this particular embodiment an outer edge 32 on the outer surface 34 of the one half 20(1) of the stationary flowpath component 20 is seated within the groove 30 along the inner surface 18 of the chamber 16. Further, a centering pin 36 is used to generally orient the one half 20(1) of the stationary flowpath component 20 in the one half 14(1) of the housing 14. In this particular embodiment, the pin 36 extends from the one half 14(1) of the housing 14 into a slot 46 in the outer surface 34 of the one half 20(1) of the stationary flowpath component 20 with a clearance 48 adjacent each side of the pin 36, although other orientations of the pin 36 and hole 46 are possible.

Next, the bushings 70 are screwed into the threaded portion 56 of each of the passages 50. One end of the bushings 70 eventually are seated against one end of the posts 60. By rotating each of the bushings 70 an equal amount, the one half 20(1) of the stationary flowpath component 20 is moved towards or away from the shaft 22 for alignment purposes. By rotating one or the other of the bushings 70, the half 20(1) of the stationary flowpath component 20 is rotated or moved laterally to the right or left with respect to the shaft 22. The amount of rotation or lateral movement may be limited by the amount of space 48 provided on the side or sides of the centering pin 36, if a centering pin 36 is used.

Next, the other half 20(2) of the stationary flowpath component 20 is placed on the one half 20(1) of the stationary flowpath component 20 along the split line C—C. The bushings 70 may protrude above the split line C—C extending into the passages 62 in the other half 20(2) of the stationary flowpath component 20.

Once the passages 50 and 62 in the halves 20(1) and 20(2) of the stationary flowpath component 20 are aligned along the split line C—C, the bolt 72 or other securing device is inserted into the passage 62 in the other half 20(2) of the stationary flowpath component 20 and is screwed down into the threaded passage 74 in the guide post 60 on each side of the one half 20(1) of the stationary flowpath component 20. This secures the halves 20(1) and 20(2) of the stationary flowpath components 20 together.

Finally, the other half 14(2) of the housing 14 is placed over the one half 14(1) of the housing 14 and so that an outer edge 32 on the outer surface 34 of the other half 20(2) of the stationary flowpath component 20 is seated within a groove 30 along the inner surface 18 of the chamber 16 of the housing 14. The halves 14(1) and 14(2) of the housing 14 are then secured together.

Having thus described the basic concept of the invention, it will be rather apparent to those skilled in the art that the foregoing detailed disclosure is intended to be presented by way of example only, and is not limiting. Various alternations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A fluid driven machine with a shaft which rotates about a first axis, the machine comprising:

a housing having a chamber with an inner surface;

a stationary flowpath component which extends around and radially outward from the shaft to an outer surface, the stationary flowpath component disposed within the chamber with the outer surface of the stationary flowpath component adjacent to the inner surface of the housing, the stationary flowpath component comprising at least first and second portions; and at least one supporting structure comprising:

a post which is secured adjacent one end to the inner surface of the housing, the post passing through a first passage in the first portion of the stationary flowpath component;

a busing having threads along at least a portion of the outer surface, the threads of the busing engaging with threads along at least a portion of the first passage, one end of the busing engaging with the other end of the post in the first passage; and a securing device which extends through a second passage in the second portion of the stationary flowpath component and into at least a portion of the first passage, the securing device securing the first and second portions of the stationary flow path component together.

2. The machine as set forth in claim 1 wherein the supporting structure extends through a first part of the first and second portions of the stationary flowpath component and is secured adjacent one end to a first location along the inner surface of the housing and adjacent an opposing end to the second portion of the stationary flowpath component.

3. The machine as set forth in claim 1 wherein at least a portion of the bushing extends from the first passage past a split line between the first and second portions of the stationary flowpath component and into the second passage in the second portion of the stationary flowpath component.

4. The machine as set forth in claim 1 further comprising a pocket along the inner surface of the housing which mates with a protrusion formed adjacent one end of the post to detachably secure the one end of the post to the housing.

5. The machine as set forth in claim 1 wherein there is another supporting structure supporting the first portion of the stationary flowpath component in the first position, the another supporting structure adjustable to the other positions, the another supporting structure also securing the first and second portions of the stationary flowpath component together.

6. The machine as set forth in claim 1 further comprising a pin and an opening located along the inner surface of the housing and the outer surface of the first portion of the stationary flowpath component, wherein a clearance is defined along at least on one side of the pin.

7. The machine as set forth in claim 1 wherein the housing comprises at least first and second sections.

8. A fluid driven machine with a shaft which rotates about a first axis, the machine comprising:

a housing having a chamber with an inner surface;

a stationary flowpath component which extends around and radially outward from the shaft to an outer surface, the stationary flowpath component is disposed within the chamber with the outer surface of the stationary flowpath component adjacent to the inner surface of the housing, the stationary flowpath component comprising at least first and second portions; and at least one supporting structure which extends through a first passage in the first portion of the stationary flowpath component, past a split line separating the first and second portions of the stationary flowpath component, and into a second passage in the second portion of the stationary flowpath component, wherein the supporting structure adjusts the position of at least the first portion of the stationary flowpath component with respect to the shaft and the inner surface of the housing.

9. The machine as set forth in claim 8 wherein the supporting structure is secured adjacent one end to a first location along the inner surface of the housing and adjacent an opposing end to the second portion of the stationary flowpath component.

10. The machine as set forth in claim 8 wherein the supporting structure comprises:

a post which is secured adjacent one end to the inner surface of the housing, the post passing through the first passage in the first portion of the stationary flowpath component;

a bushing having threads along at least a portion of the outer surface, the threads of the bushing engaging with threads along a least a portion of the first passage, one end of the bushing engaging with the other end of the post in the first passage; and a securing device which extends through the second passage in the second portion of the stationary flowpath component and into at least a portion of the first passage, the securing device securing the first and second portions of the stationary flowpath component together.

11. The machine as set forth in claim 10 wherein at least a portion of the bushing extends from the first passage past a split line between the first and second portions of the stationary flowpath component and into the second passage in the second portion of the stationary flowpath component.

12. The machine as set forth in claim 10 further comprising an opening along the inner surface of the housing which mates with a protrusion formed adjacent one end of the post to detachably secure the one end of the post to the housing.

13. The machine as set forth in claim 8 wherein there is another supporting structure which extends through a third passage in the first portion of the stationary flowpath component, past a split line separating the first and second portions of the stationary flowpath component, and into a fourth passage in the second portion of the stationary flowpath component, wherein the supporting assemblies adjusts the position of the first portion of the stationary flowpath component with respect to the shaft and the inner surface of the housing.

14. The machine as set forth in claim 10 further comprising a pin and a notch shaped to mate with the pin located along the inner surface of the housing and the outer surface of the first portion of the stationary flowpath component, wherein a clearance is defined along at least one side of the pin.

15. The machine as set forth in claim 8 wherein the housing comprises at least first and second sections.

16. A fluid driven machine with a shaft which rotates about a first axis, the machine comprising:

a housing having a chamber with an inner surface;

a stationary flowpath component which extends around and radially outward from the shaft to an outer surface, the stationary flowpath component is disposed within the chamber with the outer surface of the stationary flowpath component adjacent to the inner surface of the housing, the stationary flowpath component comprising at least first and second portions;

at least one supporting structure adjustable to alter a position of at least the first portion of the stationary flowpath component with respect to the shaft and the inner surface of the housing; and a pin and a notch shaped to mate with the pin located along the inner surface of the housing and the outer surface of the first portion of the stationary flowpath component, wherein a clearance is defined along at least one side of the pin.

17. The machine as set forth in claim 16 further comprising a second space is defined along an opposing side of the pin.

18. The machine as set forth in claim 16 wherein the supporting structure extends through a first part of the first and second portions of the stationary flowpath component and is secured adjacent one end to a first location along the inner surface of the housing and adjacent an opposing end to the second portion of the stationary flowpath component.

19. The machine as set forth in claim 16 wherein there is another supporting structure securing the first and second portions of the stationary flowpath component together and adjusting the position of the first and second portions of the stationary flowpath component with respect to the shaft and the inner surface of the housing.

20. A method for adjusting components in a chamber of a housing of a fluid driven machine, the housing having a shaft which rotates about a first axis and is located at least partially within the chamber, the method comprising:

adjusting a position of a first portion of a stationary flowpath component with respect to the shaft in the chamber;

securing one end of the supporting structure which extends through the first portion of the stationary flowpath component to a first location along an inner surface of the chamber; and securing an opposing end of the supporting structure to the second portion of the stationary flowpath component.

21. The method as set forth in claim 20 wherein the step of adjusting comprises raising or lowering the first portion of the stationary flowpath component with respect to the shaft.

22. The method as set forth in claim 21 wherein the step of adjusting further comprises rotating the first portion of the stationary flowpath component with respect to the shaft.

23. The method as set forth in claim 20 wherein the step of adjusting comprises:

securing one end of a post to an inner surface of the chamber;

placing a first passage in the first portion of the stationary flowpath component over the post so that an outer surface of the stationary flowpath component is located adjacent to the inner surface;

installing a busing into the first passage; and adjusting the busing to alter the position of the first portion of the stationary flowpath component.

24. A method for adjusting components in a chamber of a housing of a fluid driven machine, the housing having a shaft which rotates about a first axis and is located at least partially within the chamber, the method comprising:

adjusting a position of a first portion of a stationary flowpath component with respect to the shaft in the chamber with at least one supporting structure;

aligning a second passage in the second portion of the stationary flowpath component with the first passage; and securing the first and second portions of the stationary flowpath components together with a securing device which extends through the second passage and into the first passage.

25. The method as set forth in claim 24 wherein the step of adjusting comprises the use of a pair of the supporting assemblies.

* * * * *